US005636676A

United States Patent [19]

Fishlin

[11] Patent Number: 5,636,676

[45] Date of Patent: Jun. 10, 1997

[54] VERTICALLY ADJUSTABLE WINDOW TREATMENTS CONTAINING ART GLASS

[76] Inventor: Michelle F. Fishlin, 30 Quaker Rd., Middletown, N.J. 07748

[21] Appl. No.: 444,282

[22] Filed: May 18, 1995

[51] Int. Cl.[6] ..... E06B 9/30

[52] U.S. Cl. ..... 160/168.1; 160/236

[58] Field of Search ..... 160/236, 900, 160/178.1 R, 168.1 R

[56] References Cited

U.S. PATENT DOCUMENTS

| | | | |
|---|---|---|---|
| 2,074,482 | 3/1937 | Martens | 156/17 |
| 2,395,073 | 2/1946 | Schepmoes | 160/85 |
| 3,186,473 | 6/1965 | Myers et al. | 160/26 |
| 4,899,491 | 2/1990 | Okumoto | 49/62 |
| 4,911,220 | 3/1990 | Hiller | 160/236 |
| 4,930,562 | 6/1990 | Goodman | 160/236 |
| 5,029,413 | 7/1991 | Jovanovic | 49/84 |
| 5,105,870 | 4/1992 | Merjane | 160/236 |
| 5,203,395 | 4/1993 | Koller et al. | 160/263 |
| 5,263,529 | 11/1993 | Landis | 160/236 |
| 5,269,361 | 12/1993 | Ryden et al. | 160/236 |
| 5,271,447 | 12/1993 | Aronovich | 160/236 |

*Primary Examiner*—Blair Johnson
*Attorney, Agent, or Firm*—Thomason & Moser

[57] ABSTRACT

A vertically adjustable window treatment comprising a control mechanism and a window covering portion that contains art glass that provides the appearance of stained glass. Manipulation of the control mechanism positions the window covering portion and defines an amount of a window adjacent to the window treatment that is covered by the window covering portion. Specifically, the vertically adjustable window treatments illustratively include: a horizontal blind mechanism, a roller shade, a roman shade, and a shutter with rotatable vanes. Such vertically adjustable window treatments provide a stable environment into which art glass can be incorporated without breakage and without interfering with the normal operation of the window treatment. As such, these window treatments combine the beauty of art glass with the flexibility of vertical adjustability.

4 Claims, 6 Drawing Sheets

VERTICALLY ADJUSTABLE WINDOW TREATMENTS CONTAINING ART GLASS

BACKGROUND OF THE DISCLOSURE

1. Field of the Invention

The invention relates to a new and improved vertically adjustable window treatment, and in particular, to a vertically adjustable window treatment containing art glass.

2. Description of the Background Art

Traditionally, a stained glass panel or window is created by joining together individually-colored elements of glass or a similar material to form a composite panel or window of significant luminance and color. The resulting decorative panels are typically utilized as either a structural element wherein the panel is permanently affixed within a wall, as a window, or as an ornamental object where the panel is provided with an appropriate border and is mounted for display.

On the other hand, window treatments are typically flexible material or adjustable apparatus which covers a conventional transparent window. Well-known window treatments include horizontal blinds, vertical blinds, window shades, the family of roman shades and various types of curtains and drapes. Each of these window treatments is designed to selectively block light that passes through a transparent window. In addition, window treatments provide privacy and add to the decor of a room. A user generally controls the amount of light that passes through the window treatment by adjusting some characteristic of the window treatment itself. For example, in horizontal blinds, the user adjusts the angle of each horizontal vane such that light passing through an adjacent window is partially blocked by each vane. Alternatively, with further adjustment, the horizontal vanes attain a spaced-apart parallel relation such that substantially all the light that passes through the adjacent window also passes through the horizontal blinds. Typically, window treatments are made of an opaque material and may be decorated with a printed design which is either applied directly to the window treatment material by a printing or embossing process, or placed as a coating upon the window treatment in the form of covering sheet, such as fabric or other printed material. In this manner, the window treatment can be coordinated, for example, with the color scheme of a room or the wallpaper and/or fabrics utilized in connection therewith.

One example of a horizontal blind system being decorated with a printed design is disclosed in U.S. Pat. No. 5,263,529 issued Nov. 23, 1993. The '529 patent discloses the application of a decorative decal to each of the vanes in a horizontal blind system to provide a decorative covering for the blinds. When the blinds are closed, the individual decorative decals on each vane form one comprehensive image. The vanes are conventional opaque vanes that, when closed to form the decal image, block substantially all the light from an adjacent window.

In an example of a horizontally adjustable window treatment, U.S. Pat. No. 5,029,413 issued Jul. 9, 1991, a vertical window blind system includes vertical vanes that are formed of unitary sheets of acrylic plastic. Each vane includes a plurality of colored plastic elements attached to the plastic sheet to provide a stained glass-like look for each vane. As with conventional vertical blinds, each vane is attached at a top end to a mechanism that rotates each vane about a vertical axis. Such rotation opens and closes the blinds. When all the vanes are closed, the overall image formed by the vanes, taken together, simulates a conventional stained glass window panel, although the vanes are, in fact, fabricated of plastic. A vertical blind system such as that disclosed in the '413 patent cannot utilize actual stained glass elements because the vertical window blinds are large and generally have substantial length. Such large vanes, if made of stained glass, are relatively heavy and would require a substantial frame to support the glass. Furthermore, since these large vertical vanes are only supported at a top end, upon closing the blinds or if wind passes through the blinds, the vanes impact one another and the stained glass would become broken. To avoid these substantial problems of incorporating stained glass into a window treatment, the '413 patent discloses using the unitary plastic sheet with colored plastic elements glued thereto. Consequently, heretofore, actual stained glass has not been incorporated into window treatments.

Although vertically adjustable window treatments, i.e., window treatments that, in some manner, move vertically with respect to an adjacent window, are generally more stable than horizontally adjustable window treatments, neither stained glass, stained glass-like material nor any other art glass material has, heretofore, ever been incorporated into vertically adjustable window treatments such as horizontal blinds, shutters, roller shades, or various types of roman shades. As such, the beauty of stained glass windows has heretofore not been combined with the most flexible and stable of window treatments, vertically adjustable window treatments.

Therefore, a need exists in the art for vertically adjustable window treatments that include stained glass, stained glass-like material or other art glass material such that a window treatment can provide the beauty of stained glass and the flexibility of a conventional vertically adjustable window treatment.

SUMMARY OF THE INVENTION

The disadvantages heretofore associated with prior art window treatments are overcome by incorporating elements fabricated of art glass into a vertically adjustable window treatment. The invention comprises a window covering portion that contains at least one art glass element and a mechanism for vertically adjusting the window covering portion with respect to a window. In general, a vertically adjustable window treatment is any window treatment having a window covering portion that moves vertically, in any manner, to cover more or less of an adjacent window. Such vertically adjustable window treatments include horizontal blinds, shutters having rotatable shutter vanes, roller shades, various types of roman shades and the like. Furthermore, art glass elements, as used herein, include any material that is intended to provide the look of stained glass, including actual stained glass, stained glass-like material, decorative glass, printed or painted plastic, and the like.

More specifically, a first embodiment of the present invention comprises a window covering portion having a plurality of panels or vanes oriented in horizontal alignment within a horizontal blind mechanism. Each vane is an individual art glass panel. The art glass vanes are themselves mounted in a three-string mounting structure such that each individual vane member is rotatable about a horizontal axis as well as vertically adjustable. As the art glass vanes are rotated into a substantially vertical position, the vanes essentially form a single vertical plane. However, because the vanes are supported within a three-string mounting structure, the vanes are stable and do not impact one another in such a manner that would cause damage to the vanes.

Depending upon the vane length, additional stability and support can be provided by adding two-string support structures.

In an alternative embodiment of the invention, a number of the vanes within the horizontal blind mechanism are conventional opaque horizontal vanes and a number of the vanes are art glass vanes. A further optional feature of the invention enables the conventional vanes to open and close separately from some or all of the art glass vanes which are "locked" in the closed position by a vane locking device. The "locked" vanes give the appearance of a single art glass panel. By removal of the locking device, the art glass vanes can be "unlocked" to permit them to freely rotate.

Furthermore, the general inventive concept of installing art glass elements into vertically adjustable window treatments is extended to shutters having rotatable vanes, roller shades, and various types of roman shades. For example, in a horizontal shutter, art glass vanes replace the typical wooden shutter elements. In a roller shade type window treatment, an art glass panel can be attached to the roller shade itself. Additionally, in a roman shade type window treatment, art glass elements are mounted directly to the cloth that forms the roman shade. In each case, the inclusion of the art glass element does not interfere with the vertical motion of the window treatment mechanisms.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present invention is a vertically adjustable window treatment containing one or more art glass elements. An art glass element, as used herein, includes any element fabricated from a material or a combination of materials that is intended to provide the look of stained glass. Such materials include actual stained glass, stained glass-like material, decorative glass, printed or painted plastic, and the like.

More specifically, the invention comprises a window covering portion that contains at least one art glass element and a mechanism for vertically adjusting the window covering portion with respect to an adjacent window. The vertical adjustment generally alters the amount of window covered by the window covering portion. More specifically, vertically adjustable window treatments include horizontal blinds, various types of roman shades, roller shades, and rotatable shutters. Each of these types of window treatments forms an embodiment of the invention. Importantly, the vertically adjustable window treatments form a stable environment into which art glass elements can be incorporated without the likelihood that the elements will become broken or that the elements will cause a malfunction in the normal operation of the window treatment. Furthermore, such an arrangement combines the beauty of stained glass with the flexible operation of vertically adjustable window treatments.

Figure 1:
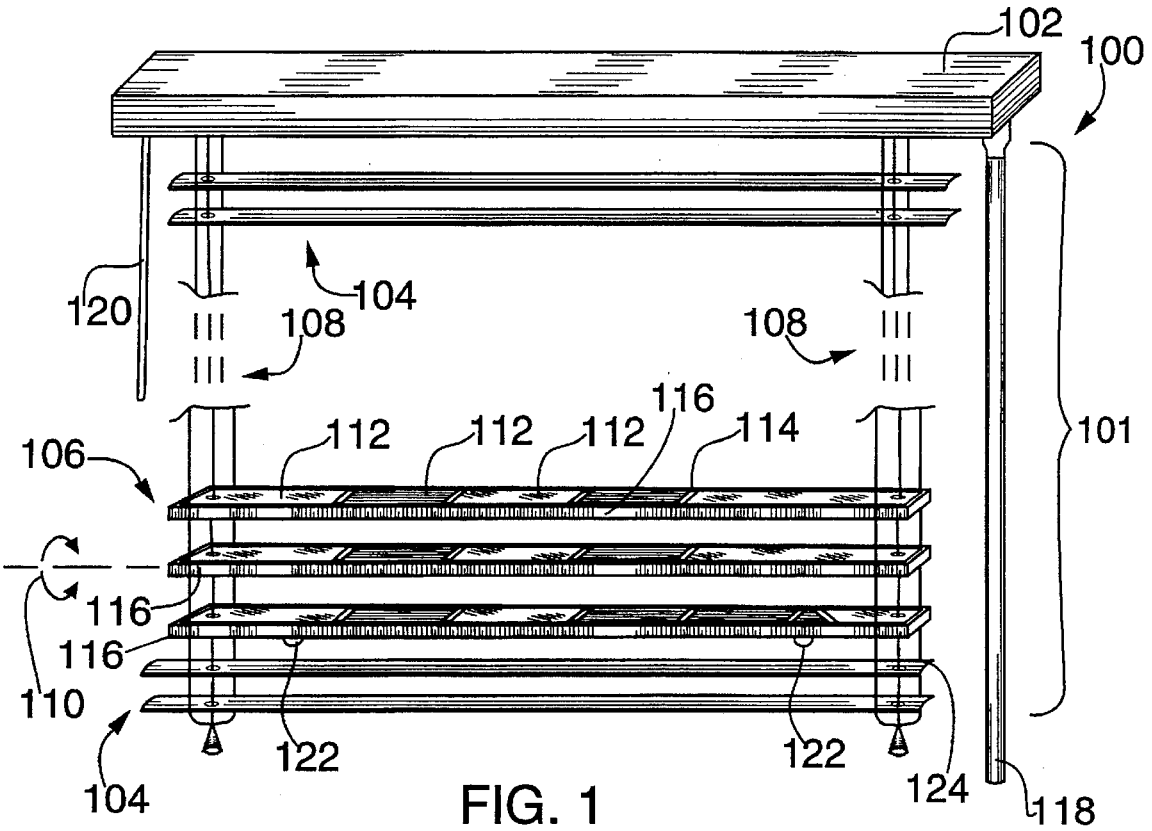
FIG. 1 depicts perspective view of a horizontal blind mechanism containing at least one vane having an art glass element.

FIG. 1 depicts a horizontal blind mechanism 100 containing a horizontally deposed adjustment mechanism 102 as well as a window covering portion 101 formed of a plurality of conventional blinds or conventional blind vanes 104 and at least one vane 106 made of art glass material. The material comprising these vanes may be actual stained glass or any material that provides the appearance of stained glass, hereinafter, for simplicity these vanes are referred to as art glass vanes which is intended to represent any material that provides the appearance of stained glass. Additionally, although FIG. 1 depicts a mix of art glass vanes 106 and conventional vanes 104, all the vanes could, of course, be art glass vanes. When a mix of vane types are used, the lowermost art glass vane includes anti-scratch bumpers 122 that ensure that the art glass vane does not scratch the underlying conventional vane 124. The bumpers are typically fabricated of rubber or plastic and are glued to the frame of the lowermost art glass vane.

Each of the vanes is supported by a three-string control mechanism 108 proximate each end of each vane 104 and 106. The vanes are mounted in spaced-apart horizontal relation such that upon motion of the three-string support structures, the vanes rotate about a horizontal axis (for example, axis 110). As is well-known in the horizontal blind art, the position of the vanes is controlled by rotation of rod 118. In this manner, the vanes may be moved into an overlapping, closed position where the vanes substantially form a single, vertical plane.

Additionally, when the vanes are in either the open or closed position, string 120 can be pulled downward, raising both of the three-string support structures. Consequently, the vanes rise, starting with the bottom most vane, toward the adjustment mechanism 102. String 120 can also be released to lower the vanes. Although art glass vanes are incorporated into the mechanism, the art glass vanes do not interfere with the vertically adjustable function of the blind mechanism 100. As such, the blind mechanism can adjust an amount of the window that is covered by the window covering portion of the invention.

Each art glass vane contains a plurality of individual colored glass elements 112. Each colored glass element is connected to other colored glass elements by came or beading 114 (also known as separators) using a traditional art glass fabrication technique. The beading 114 may be formed of metal, plastic, or any other rigid material. Typically, the beading is lead, zinc, brass, or some other metal. To provide sufficient support such that the art glass vane will not sag or bow near the middle of the vane and to minimize the frame's weight, a four-sided frame 116 of each art glass vane is typically made of brass or some other rigid material. If lead is used, it may be glued to the glass using an adhesive. If, for aesthetic reasons, lead is used and glued to the outer edge of a art glass vane, care should be taken to limit the length of the vane to prevent sagging. Alternatively, a third three-string support structure or a two-string support structure (i.e., a three-string support structure without the center string) can be added to the blind to add support. Depending on the length of the vane, more support structures can be added to ensure that the vane does not sag.

One illustrative example of a technique that is useful in fabricating the art glass vanes 106 from stained glass involves: (1) forming a paper pattern for the glass elements; (2) transferring the pattern to one or more glass sheets using a marker or pattern cutouts; (3) cutting the glass sheets to form glass elements; (4) constructing three sides of a frame for the vane by soldering brass edge pieces at the corners; (5) slipping the glass elements into the three-sided frame and inserting brass separators (beading) between the glass elements; (6) soldering the separators in place; (7) soldering a fourth frame piece to the existing three frame pieces to complete the art glass vane; and (8) drilling two holes through the glass to enable a center string of each three-string support structure to pass through the vane. Using brass frame pieces and separators ensures that the vane is rigid and lightweight. The frame pieces and separators are shaped to capture the edges of the glass elements without using an adhesive. Specifically, the frame pieces have a hemispherical or U-shaped cross-section and the separators have an H-shaped cross-section. However, for added rigidity or, if lead, plastic, or some other less rigid material is used, an adhesive may be necessary to provide sufficient rigidity for the vane.

Of course, as briefly mentioned above, the art glass elements include the use of plastic elements (i.e., a stained glass-like material) that simulate the look of stained glass. Furthermore, to fabricate an inexpensive vane using a art glass-like material, a unitary plastic vane is printed or painted with a pattern that looks like stained glass elements in combination with separators and frame pieces.

The foregoing description assumes that the inventive window treatment is pre-assembled at the manufacturer. Alternatively, the art glass vanes (or an assembly kit for the vanes) is sold separately from the blind mechanism. As such, the vanes are retrofitted to an existing horizontal blind by a retailer or the end-user. To accomplish such a retrofit, the three-string support structures are disassembled and some or all of the conventional opaque vanes are replaced with art glass vanes. The art glass vanes are either pre-assembled or purchased as a kit for the end-user to assemble.

Figure 2:
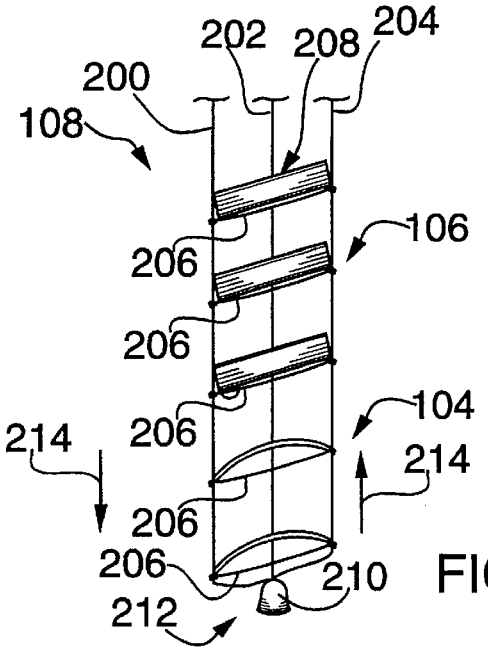
FIG. 2 depicts a side view of the horizontal blind mechanism of FIG. 1.

FIG. 2 depicts a close-up of one of the three-string support structures 108. A first string 200 and a second string 204, which are vertically movable with respect to one another, are attached to one another by a plurality of support strings 206. Upon each support string rests one of the vanes 104 or 106. A third string 202, which is an alignment string, is threaded centrally through a hole 208 in each of the vanes. All three strings 200, 202 and 204 are tied to one another below the bottom most vane and then attached to a plug 210 that forms a support 212 for the bottom most vane. To support the weight of the art glass vanes, the strings are typically fabricated of heavier material (e.g., thicker strings) than are generally used in conventional horizontal blinds. In operation, the adjustment mechanism 102 moves the first and second strings 200 and 204 in opposite directions (as shown by arrows 214) such that the support strings 206 move from a substantially horizontal position into a substantially vertical position. Consequently, the vanes move with the support strings to open or close the blinds. Additionally, string 202, when moved upward or downward, vertically adjust the vanes with respect to an adjacent window (not shown). Such vertical adjustment determines an amount of the window that is covered by the window covering portion of the invention.

Figure 3:
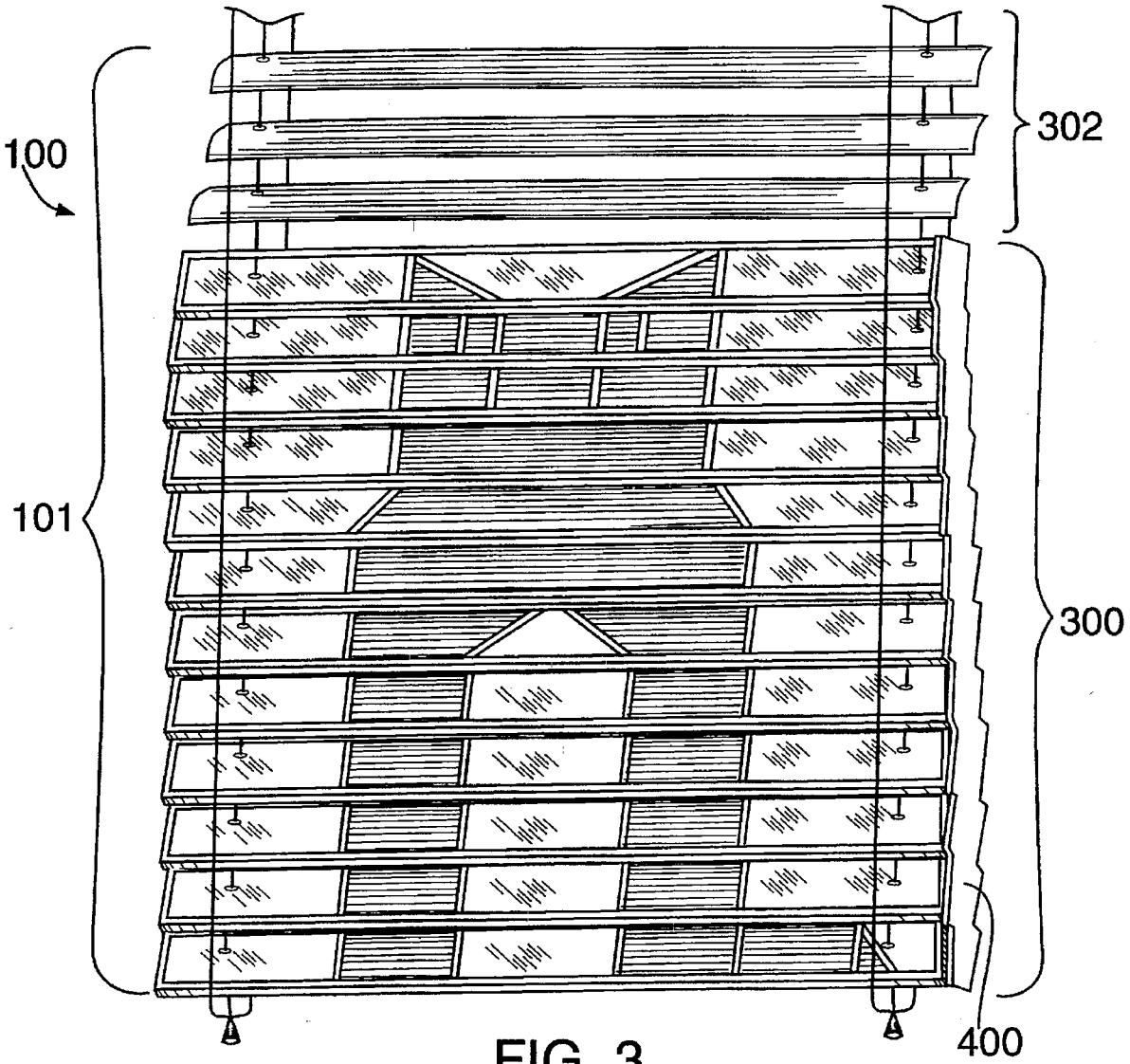
FIG. 3 depicts a perspective view of the blind mechanism of FIG. 1 in a closed position.

FIG. 3 depicts the art glass portion 300 of the window covering portion 101 of FIG. 1 in the closed position such that the vanes substantially form a single vertical plane. Furthermore, the conventional blind portion 302 can be independently adjusted into the open position and the art glass portion can simultaneously be in the closed position. With the conventional blind vanes in the open position, direct sunlight passes through that portion of the blind mechanism. Such a two-part blind arrangement provides an end-user with flexible lighting and decor options, and the appearance of a stained glass panel as the design is visible at all times even when the remaining vanes are open.

Of course, those skilled in the art will understand that art glass vanes can be placed in all the vane locations of the window covering portion of the horizontal blind mechanism such that there are no conventional blind vanes. The actual number of art glass vanes within invention is a design choice that is made depending on each application of the art glass window treatment.

Figure 4:
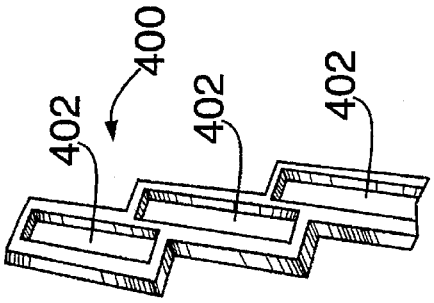
FIG. 4 depicts a perspective view of a vane locking device.

FIG. 4 depicts a perspective view of a vane locking device 400. This device attaches to the vanes (e.g., to one or both ends of the closed art glass vanes) to "lock" them in the vertical, closed position shown in FIG. 3. As such, the conventional blind vanes operate as usual (e.g., vertically and horizontally adjustable) and the art glass vanes remain in a closed position no matter what the position of the conventional blind vanes.

Specifically, device 400 is typically fabricated from injection molded plastic or any other lightweight material. The device contains a plurality of apertures 402 that snugly fit over the ends of the art glass vanes. As such, the art glass vanes are substantially maintained in a vertical position.

Figure 5:
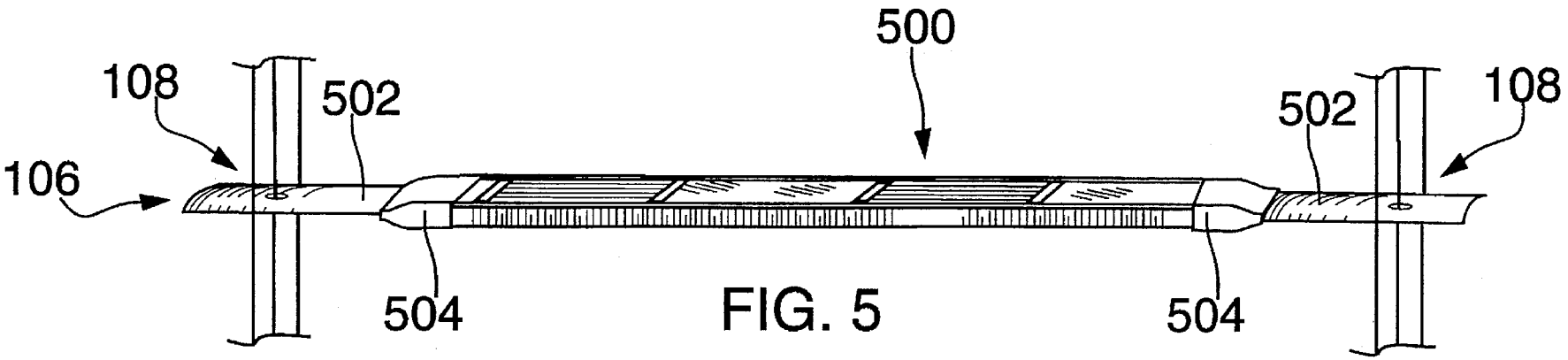
FIG. 5 depicts a perspective view of a horizontal blind mechanism wherein a central portion of an art glass vane is mounted between two vane extensions.

FIG. 5 depicts a perspective view of an alternative embodiment of the invention where art glass vanes 106 (only one of which is depicted) are formed by mounting a central portion 500 containing art glass between extension vanes 502. The extension vanes are supported by three-string support structures 108. One end of each extension vane 502 is connected, by a coupler 504, to the central portion 500 of the art glass vane 106. Each coupler is fabricated of either metal or plastic and is crimped, glued, or attached in some other manner to both the central portion and the extension vane. As such, the central portion of the art glass vane is mounted between the extension vanes without the necessity of drilling holes in the glass for passage of the second string of the support structure. The extension vanes are typically fabricated of the same material as the non-art glass vanes which is typically a rigid material such as plastic or wood that can support the central portion.

Figure 6:
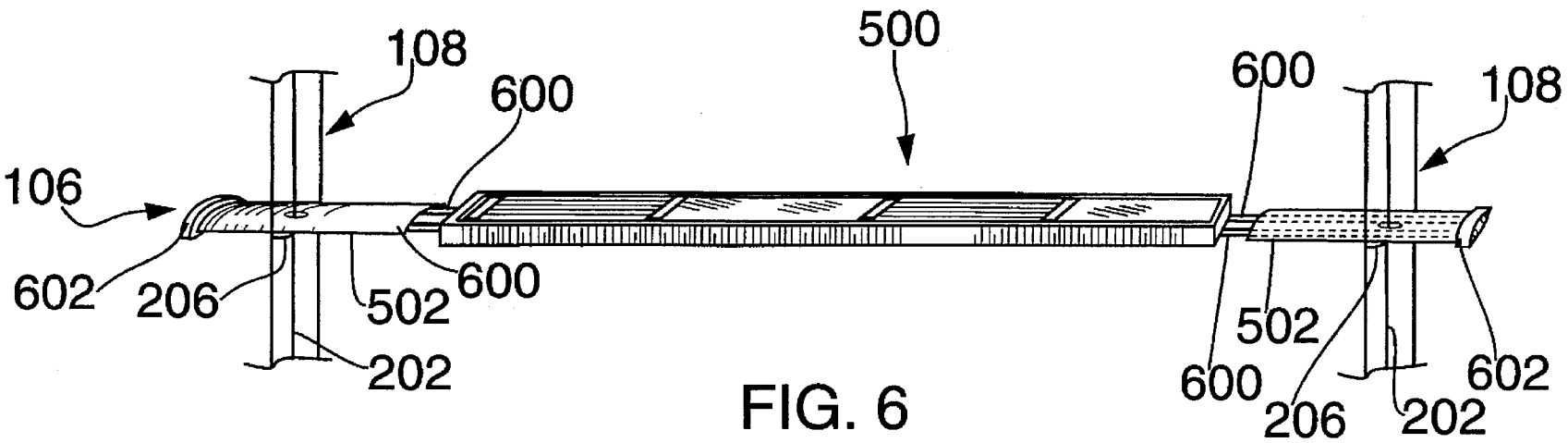
FIG. 6 depicts a perspective view of an alternative connector for attaching the central portion of an art glass vane to a vane extension.

FIG. 6 depicts another alternative embodiment of the invention where each central portion 500 of the art glass vane 106 contains reinforcing bars 600 that extend from each end of the central portion. These bars extend beneath the extension vanes 502, but over the support string 206 of the support structure 108 and on each side of the center string 202. An end cap 602, at each end of vane 106, attaches the bars 600 to the respective extension vane 502. In this embodiment, the art glass vane is not directly supported by the extension vanes, but is rather supported by the extension bars. Consequently, the extension vanes are not required to be rigid.

Figure 7:
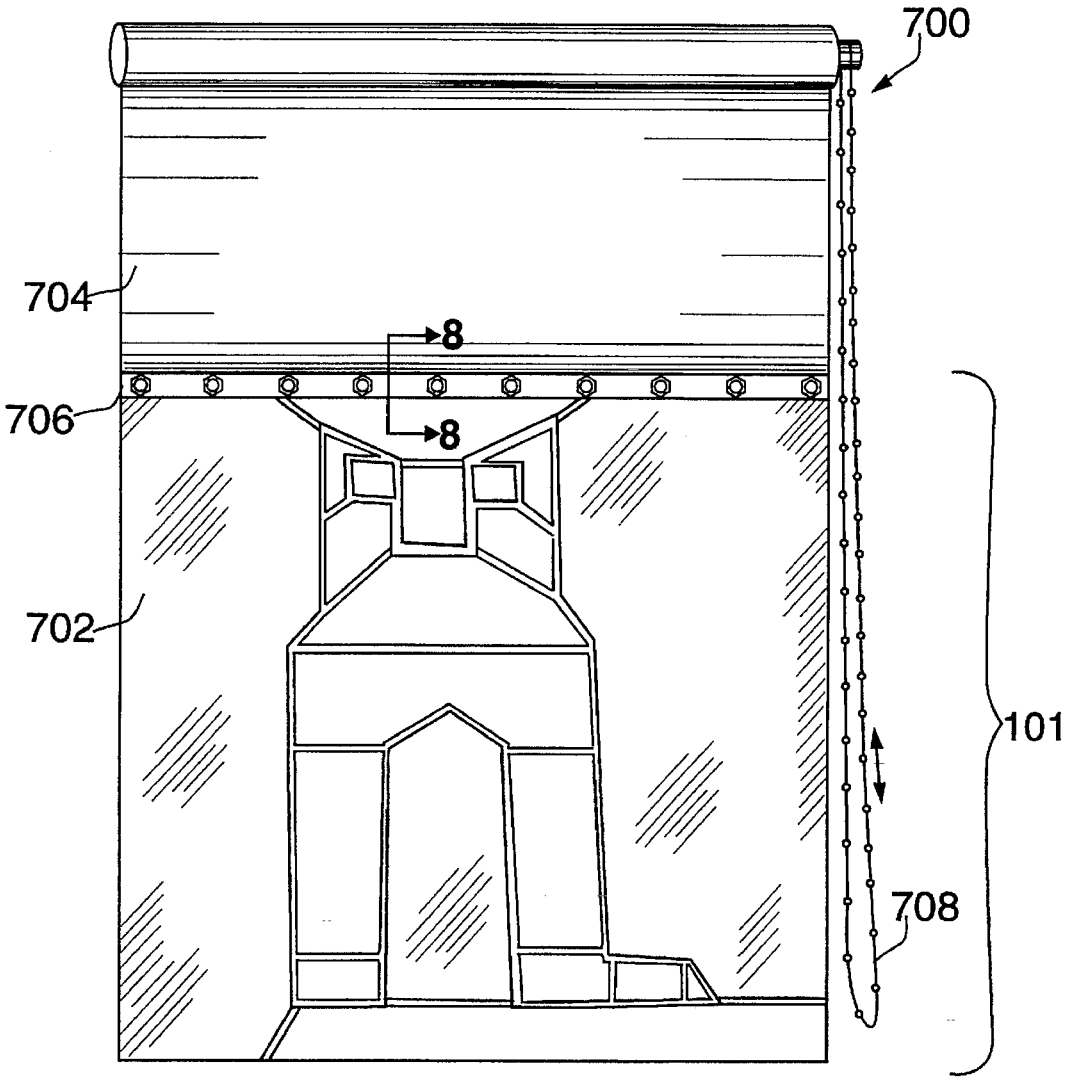
FIG. 7 depicts a perspective view of a roller shade-type window treatment containing an art glass panel.

FIG. 7 depicts a perspective view of another embodiment of the invention. In this embodiment, the window covering portion 101 is a window shade 704 of a roller shade-type window treatment 700 having incorporated therein an art glass panel 702. The art glass panel 702 is attached to the window shade 704 across its horizontal dimension using an attachment apparatus 706. The shade is vertically adjusted, raised and lowered, by manipulating chain 708. This chain, in turn, operates a conventional ratchet mechanism that raises and lowers the shade. Alternatively, the mechanism for raising and lowering the shade is a conventional spring-loaded roller shade mechanism.

Figure 8:
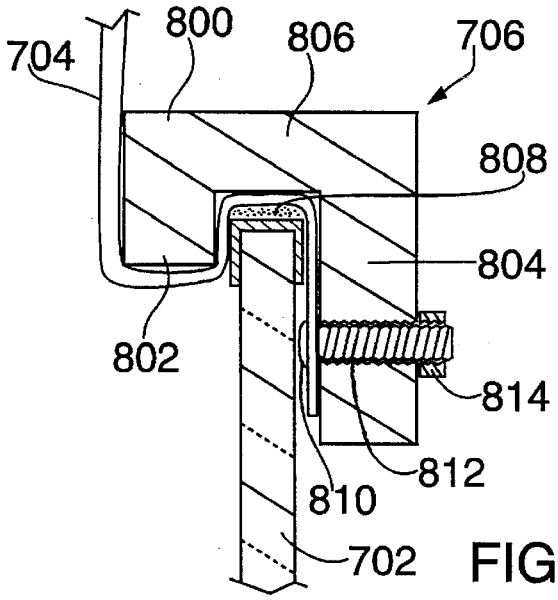
FIG. 8 depicts a cross-sectional view of a connector for connecting an art glass panel to a roller shade-type window treatment.

FIG. 8 depicts a cross-sectional view of attachment apparatus 706 along line 8—8 in FIG. 7. Apparatus 706 securely attaches a conventional roller-type window shade 704 to an art glass panel 702. The attachment apparatus contains a U-shaped element 800 having a first leg 802 and a second leg 804 interconnected by a third portion 806 to form the U-shape. Adhesive 808 is applied to the inner surface of U-shaped element 800 to affix the art glass panel 702 to the element 800 and to the window shade 704. To further attach the U-shaped element to the window shade 704, the shade material is threaded around leg 802 of the U-shaped element. A screw 810 passes through a hole 812 in leg 804 as well as through holes punched or cut in the window shade material on both sides of the leg 804 of the U-shaped element. A nut 814 threads onto screw 810 to securely fasten the window shade to the U-shaped element.

Alternatively, the U-shaped connector can be replaced with a plurality of hooks that are connected to the bottom of the window shade, and then these hooks are looped through eyelets attached to, or holes in, the art glass panel, or vice versa, that is, the hooks can be attached to the top of the art glass panel, and eyelets or holes can be arranged along the bottom edge of the roller-type shade. In either case, the art glass panel now forms a movable portion of the roller-type shade window treatment.

Figure 9:
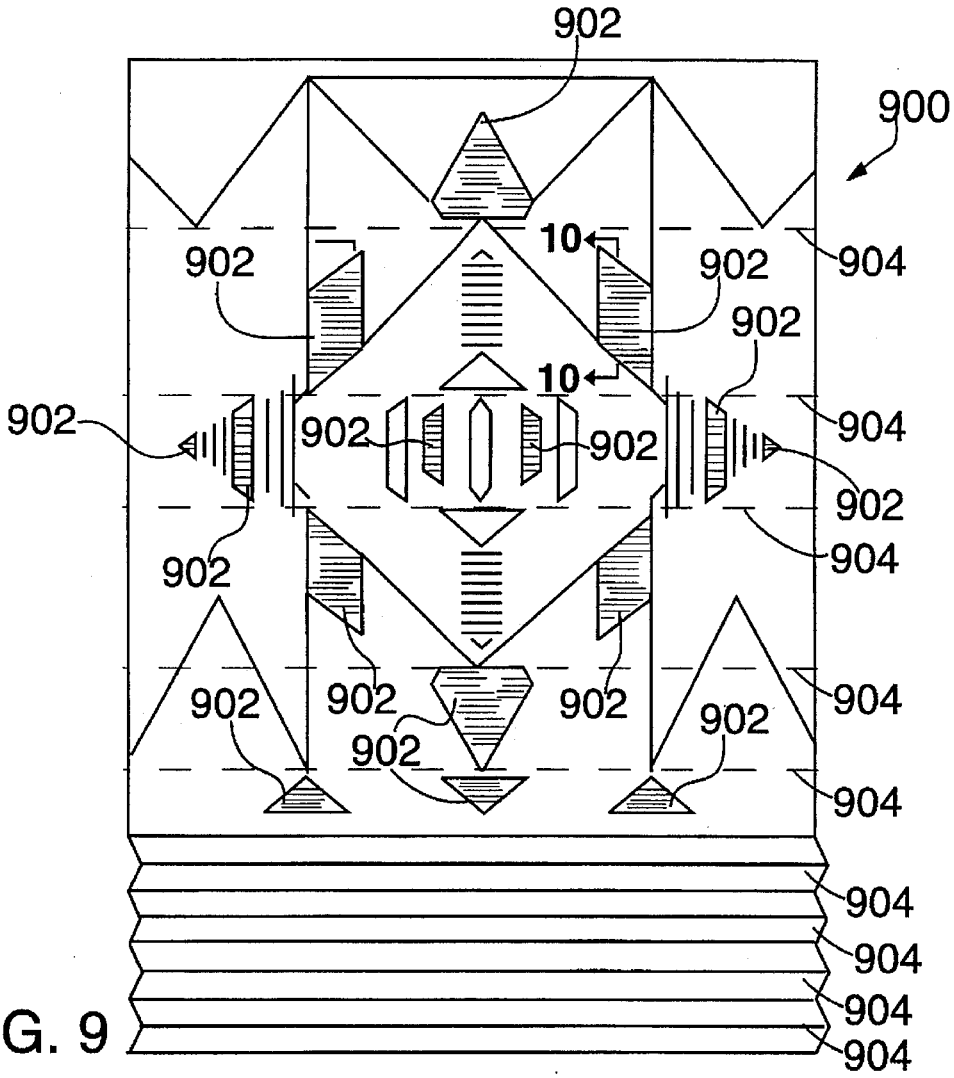
FIG. 9 depicts a perspective view of a roman shade having an art glass element incorporated therein.

FIG. 9 depicts a perspective view of a roman shade window treatment 900 containing a plurality of art glass elements 902 that are securely attached to the fabric of the roman shade. The elements 902 are sized and positioned such that the elements do not interfere with the horizontal creases or folds 904 in the shade material. In this manner, the roman shade fully functions to vertically adjust the shade material.

Although a roman shade is depicted in FIG. 9, from the following discussion, those skilled in the art will understand that this embodiment of the invention can be used in any one of the various types of shades that vertically open and close by folding along horizontal creases, pleats, or gathers in response to movement of cords and rings attached to the fabric of the shade. Such shades, generally defined herein as various types of roman shades, include cloud shades, balloon shades, roman shades, and the like. All these horizontally foldable shades are to be considered interchangeable with the roman shade described herein to illustrate the invention.

Figure 10:
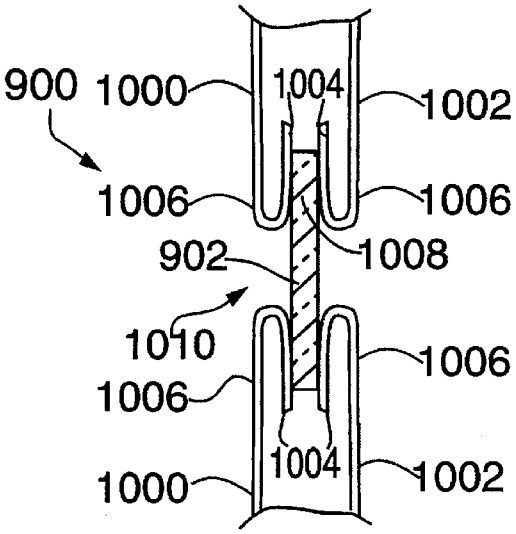
FIG. 10 depicts a cross-sectional view of an art glass element mounted in the roman shade of FIG. 9.
Figure 11:
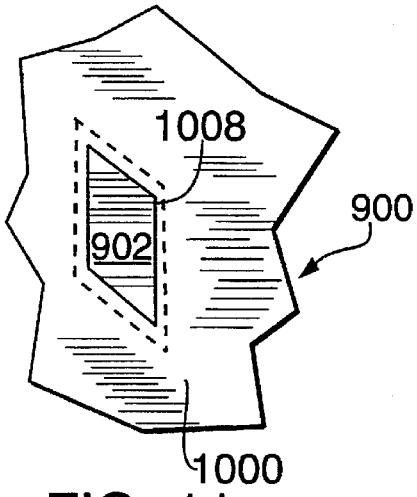
FIG. 11 depicts a front, plan view of an art glass element mounted in the roman shade of FIG. 9.

FIG. 10 shows a cross-sectional view of an art glass element 902 taken along line 10—10 in FIG. 9. FIG. 11 depicts a front, plan view of the art glass element 902 of FIG. 10. To best understand this embodiment of the invention, FIGS. 10 and 11 should be viewed simultaneously. The roman shade 900 is comprised of a front fabric sheet 1000 and a lining fabric sheet 1002. The two sheets are attached to one another along the entire periphery of the roman shade. To achieve optimal appearance of the art glass elements as sunlight illuminates the adjacent window, the lining sheet should be opaque. To provide a location for an art glass element 902 in the fabric sheets of the roman shade 900, an opening 1010 is cut into both sheets 1000 and 1002. The shape of the opening is substantially similar to, but slightly smaller than, the shape of the element 902 that will be affixed to fabric. The edges 1004 of the opening are folded back and affixed, by gluing, taping, stitching, and the like, to the adjacent fabric 1006. The circumferential edge 1008 of the art glass element 902 is glued to the folded edge of fabric sheets 1000 and 1002 that surrounds the opening in the fabric. Alternatively, the art glass element, depending upon the material of which it is fabricated, can be affixed to the fabric by stitching, taping, stapling, and the like. In this manner, each art glass element is securely fastened to the fabric sheets of a roman shade. Although a plurality of art glass elements are incorporated into the roman shade, the shade fully functions as a conventional roman shade.

Figure 12:
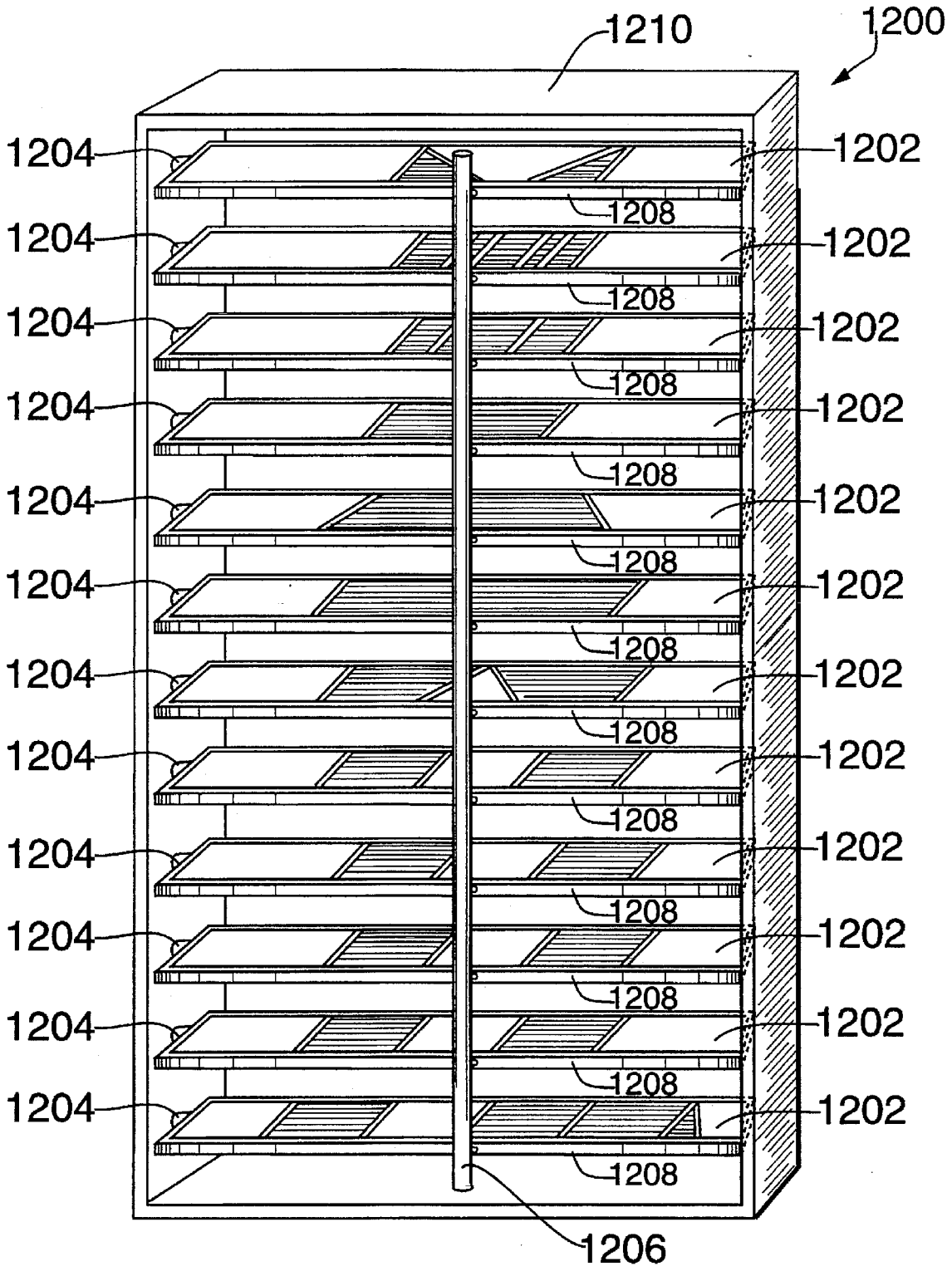
FIG. 12 depicts a perspective view of a rotatable shutter window treatment having an art glass element incorporated therein.

FIG. 12 depicts a perspective view of a shutter-type window treatment 1200 having rotatable art glass vanes 1202. In this embodiment of the invention, each conventional opaque vane has been replaced with an art glass vane 1202. Of course, a combination of art glass vanes and opaque vanes can also be arranged. The art glass vanes are similar to the art glass vanes of the horizontal blind mechanism (e.g., each vane has a frame, a plurality of art glass elements and a plurality of separators), except the shutter's vane elements are attached to a dowel 1204 at each end. The dowel is typically a metal or wooden pin that is centrally attached to each end piece of the vane frame. The pins interact with holes in the shutter frame 1210 such that each vane is rotatable about a horizontal axis extending through the pins. A control arm 1206 attaches to an edge 1208 of each vane such that as the arm 1206 is vertically moved, up or down, the vanes rotate about an axis defined by the dowels. The particular position of the control arm defines an amount of an adjacent window (not shown) covered by the vanes.

In sum, the invention is a vertically adjustable window treatment having a control mechanism and a window covering portion that contains at least one art glass element. Manipulation of the control mechanism determines an amount of a window adjacent to the invention that is covered by the window covering portion. Specifically, the vertically adjustable window treatments that form the various embodiments of this invention include: a horizontal blind mechanism, a roman shade, a roller shade, and rotatable shutters. Such vertically adjustable window treatments provide a stable environment into which art glass elements can be incorporated without breakage and without interfering with the normal operation of the window treatment. As such, the invention combines the appearance of art glass with the flexibility of vertically adjustable window treatments. Such flexibility allows the invention to adjust to allow varying amounts of light to pass through the window treatment, enable the art glass portion of the window treatment to be easily expanded by using additional elements, create a cost effective alternative to conventional stained glass window panels, and generate a window treatment that is easily customizable to fit any size window or interior decor.

Although various embodiments which incorporate the teachings of the present invention have been shown and described in detail herein, those skilled in the art can readily devise many other varied embodiments that still incorporate these teachings.

What is claimed is:

1. A vertically adjustable window treatment comprising:

a window covering portion having a plurality of elongate horizontally extending vanes, each said vane having at least one stained glass element incorporated therein, each said stained glass element comprising a piece of stained glass having opposing planar exposed surfaces, and a mechanism for vertically adjusting the window covering portion with respect to a window said mechanism further comprises:

a horizontally extending control unit having extending therefrom a vane mounting structure within which each of the horizontal vanes is pivotally mounted, said horizontal vanes being rotatable from a first position where the vanes substantially define a single plane to a second position where the vanes have a parallel spaced apart relation, and said vane mounting structure being vertically moveable whereby said mechanism controls an amount of said window covered by said window covering portion.

2. The window treatment of claim 1 wherein said plurality of horizontal vanes further comprise a plurality of horizontal vanes each containing said stained glass element and a plurality of conventional opaque horizontal vanes.

3. The window treatment of claim 2 further comprising a locking device for locking said plurality of horizontal vanes containing said stained glass element into said first position.

4. The window treatment of claim 1 wherein said horizontal vane containing said stained glass element further comprises:

a central portion containing said stained glass element; and two extension vanes, connected to each end of said central portion, said extension vanes being connected to said vane mounting structure.

* * * * *